US007829824B2

(12) United States Patent
Last

(10) Patent No.: US 7,829,824 B2
(45) Date of Patent: Nov. 9, 2010

(54) PRESSURE PICKUP HEATING BAR, IN PARTICULAR FOR A PRESSURE PICKUP GLOW PLUG

(75) Inventor: Bernd Last, Reutlingen (DE)

(73) Assignee: Beru AG, Ludwigsburg (DE)

( * ) Notice: Subject to any disclaimer, the term of this patent is extended or adjusted under 35 U.S.C. 154(b) by 1022 days.

(21) Appl. No.: 11/553,166

(22) Filed: Oct. 26, 2006

(65) Prior Publication Data

US 2007/0095811 A1 May 3, 2007

(30) Foreign Application Priority Data

Oct. 28, 2005 (DE) ..... 10 2005 051 817

(51) Int. Cl.
*F23Q 7/22* (2006.01)

(52) U.S. Cl. ..... 219/270; 219/260

(58) Field of Classification Search ..... 219/270
See application file for complete search history.

(56) References Cited

U.S. PATENT DOCUMENTS

| | | | | |
|---|---|---|---|---|
| 7,032,438 | B2 | 4/2006 | Heinzelmann et al. | |
| 2005/0061063 | A1 | 3/2005 | Haussner et al. | |
| 2005/0150301 | A1 | 7/2005 | Skinner et al. | |
| 2006/0032472 | A1 * | 2/2006 | Yamada et al. | 123/145 A |
| 2007/0023412 | A1 * | 2/2007 | Wlodarczyk | 219/270 |
| 2007/0062267 | A1 | 3/2007 | Boucard et al. | |
| 2008/0142496 | A1 * | 6/2008 | Itoh et al. | 219/270 |
| 2009/0056660 | A1 * | 3/2009 | Goto et al. | 123/145 A |
| 2009/0242540 | A1 * | 10/2009 | Itoh et al. | 219/267 |

FOREIGN PATENT DOCUMENTS

| | | | |
|---|---|---|---|
| DE | 196 80 912 | C2 | 10/1997 |
| DE | 102 18 544 | A1 | 11/2002 |
| DE | 102 05 819 | A1 | 8/2003 |
| DE | 103 46 330 | A1 | 5/2005 |
| DE | 10 2004 011 097 | A1 | 9/2005 |
| DE | 10 2004 011 098 | A1 | 9/2005 |
| DE | 102004044727 | A1 | 3/2006 |
| DE | 10 2005 051 775 | A1 | 6/2006 |
| EP | 1 460 403 | A1 | 9/2004 |
| JP | 59-85932 | A | 5/1984 |
| WO | 2005040681 | A1 | 5/2005 |
| WO | 2005043039 | A1 | 5/2005 |
| WO | 2006/034928 | A1 | 4/2006 |
| WO | 2006/072514 | A1 | 7/2006 |
| WO | 2006/111439 | A1 | 10/2006 |

* cited by examiner

*Primary Examiner*—Thor S Campbell
(74) *Attorney, Agent, or Firm*—Roberts Mlotkowski Safran & Cole, P.C.; David S. Safran

(57) ABSTRACT

A pressure pickup heating bar, in particular for a pressure pickup glow plug, having an electrical heating element (1) and a pressure sensor (3) onto which the pressure present at the heating bar (1) is transmitted. The heating bar has a support tube (2) which encompasses the heating element (1) on the outside with an axial pretension. A pressure sensor (3) is arranged between the heating element (1) and the support tube (2) and is subjected to pressure that is present on the heating bar.

9 Claims, 1 Drawing Sheet

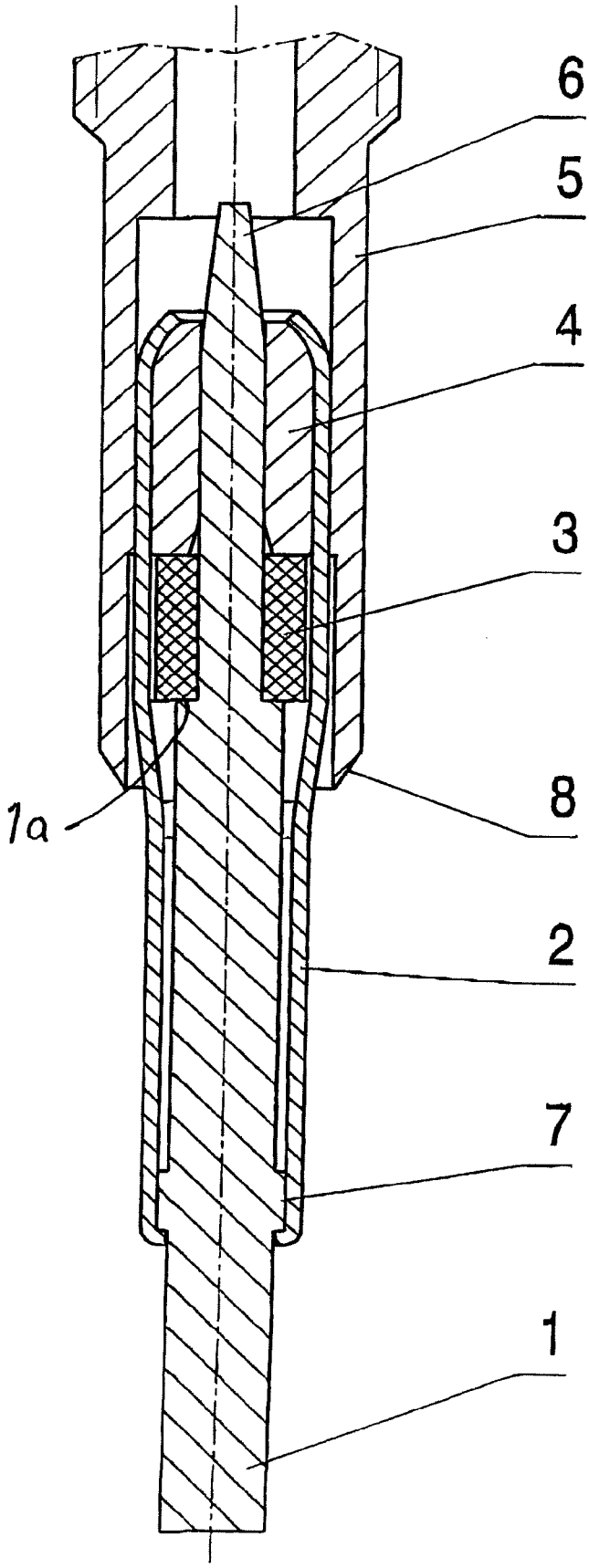
6
5
4
3
8
1a
2
7
1

PRESSURE PICKUP HEATING BAR, IN PARTICULAR FOR A PRESSURE PICKUP GLOW PLUG

BACKGROUND OF THE INVENTION

1. Field of the Invention

The invention relates to a pressure pickup heating bar, in particular for a pressure pickup glow plug, comprising an electrical heating element and a pressure sensor onto which the pressure present at the heating element is transmitted.

2. Description of the Related Art

A pressure pickup heating bar or a pressure pickup glow plug with such a heating bar is used in the case of self-igniting internal combustion engines; apart from the normal glow function, a pressure pickup heating bar or a pressure pickup glow plug with such a heating bar also has a pressure pickup function, by way of which, for example, the pressure present in the cylinder of the internal combustion engine can be determined.

Commonly used pressure pickup glow devices comprise a heating bar and a pressure sensor that is pressurized by the pressure present in the cylinder of the internal combustion engine, which pressure is transmitted to the pressure sensor by way of the heating bar.

Pressure pickup glow devices or pressure pickup glow plugs that comprise a heating bar and a pressure sensor are, for example, known from German Patent Application DE 103 43 521 A1 (that corresponds to U.S. Patent Application Publication No. 2005/0061063 A1), German Patent Application DE 10 2004 044 727 A1, German Patent Application DE 10 2004 024 341 A1 (that corresponds to U.S. Pat. No. 7,032, 438), and International Patent Application Publications WO2005/043039 A1 and WO2005/040681 A1.

Due to the voluminous geometry and the weight of the pressure or load transmission devices relative to the pressure sensor, in these known devices, there is often a resonant frequency situation within the measuring range, which resonant frequency situation causes interference.

SUMMARY OF THE INVENTION

Thus, it is a primary object of the present invention to create a pressure pickup heating bar, in particular, for a pressure pickup glow plug, which pressure pickup heating bar features a simple design and is correspondingly associated with low costs.

This object is met by a pressure pickup heating bar of the initially mentioned type in which the heating element is encompassed on the outside by an axially extensible support tube which is seated on the heating element with an axial preload; and wherein the pressure sensor is arranged in the space between the heating element and the support tube.

In the pressure pickup heating bar according to the invention, pressure pickup heating is integrated in the heating bar; no special seals and guides are required, so that costs are reduced; and by means of miniaturization, the problems associated with resonant frequency can be avoided.

The invention further covers the use of a pressure pickup heating bar according to the invention in a pressure pickup glow device and a pressure pickup glow.

Below, a particularly preferred exemplary embodiment of the pressure pickup heating bar according to the invention is described in more detail with reference to the accompanying drawing.

BRIEF DESCRIPTION OF THE DRAWINGS

The sole FIGURE is a section view of that part of the pressure pickup glow plug that is arranged at the combustion chamber end of the exemplary embodiment of the pressure pickup heating bar according to the invention.

DETAILED DESCRIPTION OF THE INVENTION

The pressure pickup glow plug part shown in the drawing essentially comprises a heating bar 1, 2, 3, 4, which is arranged in a glow plug body 5 such that the pressure pickup glow plug part axially projects from the glow plug body 5 at the combustion chamber end. The glow plug body 5 is sealed off from the cylinder head of the internal combustion engine by a seal seat 8.

The heating element 1, 2, 3, 4, comprises a heating element 1, which is preferably made of a ceramic material, and of a support tube 2 that encompasses the heating element 1 on the outside and with a degree of clearance in the part on the combustion chamber. A pressure sensor 3, which can, for example, be a piezoelectric element, and which, in response to mechanical stress, generates an electrical signal, is arranged on the heating element 1, with a clearance between it and the support tube 2 such that pressure that is present in the combustion chamber end of the heating element is transferred to the pressure sensor 3 since the pressure sensor 3 is seated on a shoulder 1*a* provided on the pressure end of the heating element 1.

The support tube 2 can be made of a metal material, i.e., an electrically conductive material, so that it contacts the heating element 1 which, on the one hand, is electrically contacted by way of an internal pole 6, and on the other hand, by way of an external pole 7, thus ensuring the return current on the external pole 7.

The support tube 2 is axially extensible, is pre-tensioned in the axial direction on the heating element 1, and together with the pressure sensor 3 forms a force circulation system that responds to external pressures, such as, for example, the combustion pressures in the interior of the cylinder of the internal combustion engine.

The axial extensibility of the support tube 2 can be matched to the respective requirements of the measuring task in one or more bellows-like deformations are provided on the support tube 2. As a result of the presence of these bellows-like deformations the extensibility in axial direction can be set as desired.

On the connection end, a press-in sleeve 4 is provided in the support tube 2, such that the press-in sleeve closes the force circulation system. To this effect, the support tube 2 is flanged over the press-in sleeve 4, wherein the press-in sleeve 4 serves as a stable element that makes it possible to tightly press into the glow plug body 5, the entire subassembly comprising the heating element 1, support tube 2, press-in sleeve 4 and pressure sensor 3. This can take place by pressing the heating element 1 against the press-in sleeve 4 or by radial force acting in the region of the press-in sleeve 4.

Contacting of the heating element 1 takes place by suitable lines that are integrated in the press-in sleeve 4, or by way of contacting between the heating element 1 and the press-in sleeve 4.

In the heating bar according to the invention, the support tube 2 is arranged directly on the heating element 1 under initial axial tension, and the pressure sensor 3 is located in the space between the heating element 1 and the support tube 2.

The support tube 2 has several functions, namely: to build up initial tension on the heating element 1; to effect load transmission to the pressure sensor 3 in that the support tube 2 is relieved; to support the heating element 1; to effect power transmission from the heating element 1; and to provide a seal in the glow plug body 5.

Although in the exemplary embodiment described above and shown in the drawing the heating element 1 extends axially right through from the combustion chamber end to the connection end and to the internal pole 6 located at that position, it is also possible for the heating element 1 to end at the pressure sensor 3 on the combustion chamber end, and for the pressure sensor 3 not to be designed in the form of a ring, as is the case in the exemplary embodiment shown, but instead to be designed as a solid cylindrical element, for example, as a cuboid or a solid cylindrical element. In this case, electrical connection is achieved by way of an external power carrier, instead of by way of the internal pole 6 as is the case in the exemplary embodiment shown.

The pressure sensor 3, for example, comprises a temperature-stable piezoelectric quartz element or an element made of piezoelectric functional ceramics. In the case of such a pressure sensor, a linear pressure/charge conversion can be set which, by way of suitable electronics, can be converted to a normal voltage signal as a sensor output signal. Due to the thermally exposed installation position, it is preferred for the electronics to provide temperature compensation of the measuring signal.

Although, above, the use of the heating bar according to the invention has been described in the context of a pressure pickup glow plug with a glow plug body 5, the heating bar according to the invention can be used in any desired pressure pickup glow device that comprises a corresponding retainer for the heating bar.

It is of particular importance that the heating bar according to the invention is firmly arranged, for example, press-fitted, in the retainer in the connection-end region, in particular, in the region of the press-in sleeve 4. It is also possible to weld the heating bar in such a retainer, wherein in this case the press-in sleeve need not necessarily be provided.

With this embodiment, a situation is achieved where the pressure sensor is decoupled from any deformation of the retainer, e.g., of the cylinder head of an internal combustion engine, in which cylinder head the heating bar is arranged.

The heating bar according to the invention operates as follows: due to the axially tensioned arrangement of the support tube 2 on the heating element 1, initial axial tension is present at the pressure sensor 3. When the heating bar is pressurized by an external pressure, that pressure is added to the initial tension already present at the pressure sensor 3 in the form of an additional force. The voltage signal that results from this is tapped off and is processed to form a pressure signal which reflects the pressure present at the heating element 1.

What is claimed is:

1. A pressure pickup heating bar, comprising an electrical heating element and a pressure sensor onto which the pressure present at the heating element is transmitted, wherein the heating element is encompassed on the outside by an axially extensible support tube which is seated on the heating element with an axial preload;

wherein the pressure sensor is arranged in a space between the heating element and the support tube, wherein the pressure sensor is a ring-shaped element which is seated on the outside of a bar-shaped heating element, and wherein a connection end of the heating element comprises an internal pole and a pressure end of the heating element comprises an external pole that contacts the support tube, the support tube being made of an electrically conductive material.

2. The pressure pickup glow plug according to claim 1, wherein a press-in sleeve is arranged in the support tube on an end of the pressure sensor that faces away from a direction of pressurization.

3. The pressure pickup glow plug according to claim 1, wherein the pressure sensor is a ring-shaped element which is seated on the outside of a bar-shaped heating element, wherein a connection end of the heating element comprises an internal pole and a pressure end of the heating element comprises an external pole that contacts the support tube, the support tube being made of an electrically conductive material.

4. The pressure pickup glow plug according to claim 1, wherein the pressure sensor comprises a solid element which is contacted by the heating element on a pressure end, wherein electricity is supplied by way of an external power supply line.

5. The pressure pickup glow plug according to claim 3, wherein the pressure sensor is seated on a shoulder provided on the pressure end of the heating element.

6. A method of using a pressure pickup heating bar having an electrical heating element and a pressure sensor onto which the pressure present at the heating element is transmitted, the heating element being in part encompassed on the outside by an axially extensible support tube which is seated on the heating element with an axial preload; and the pressure sensor being arranged in a space between the heating element and the support tube, in a pressure pickup glow plug, comprising the step of tightly affixing a connection end of the pressure pickup heating bar to a glow plug body of the pressure pickup glow plug.

7. The method according to claim 6, wherein the step of affixing the pressure pickup heating bar is performed by press-fitting it in the glow plug body.

8. The method according to claim 6, wherein the step of affixing the pressure pickup heating bar is performed by welding it in the glow plug body.

9. A pressure pickup glow plug for insertion into a cylinder head of a combustion engine having a glow plug body comprising a seal seat at a combustion chamber end for sealing the glow plug body against the cylinder head, and pressure pickup heating bar affixed in the glow plug body, the pressure pickup heating bar comprising an electrical heating element and a pressure sensor onto which the pressure present at the heating element is transmitted, wherein part of the protruding portion of the heating element is encompassed on the outside by an axially extensible support tube and wherein the pressure sensor is arranged in a space between the heating element and the support tube, and wherein the support tube is seated on the heating element with an axial preload that places the pressure sensor under axial tension so that the pressure sensor is decoupled from deformation of the glow plug body.

* * * * *